US006186614B1

(12) United States Patent
Nagashima

(10) Patent No.: US 6,186,614 B1
(45) Date of Patent: Feb. 13, 2001

(54) INK JET RECORDING APPARATUS HAVING WIPING BLADE INK SPLASH PREVENTION

(75) Inventor: Masasumi Nagashima, Yokohama (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/831,756

(22) Filed: Apr. 1, 1997

Related U.S. Application Data

(63) Continuation of application No. 08/372,958, filed on Jan. 17, 1995, now abandoned.

(30) Foreign Application Priority Data

Jan. 18, 1994 (JP) ..... 6-017862

(51) Int. Cl.[7] ..... B41J 2/165
(52) U.S. Cl. ..... 347/33
(58) Field of Search ..... 347/22, 23, 33

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,164,748 | 11/1992 | Katayanigi et al. | 347/33 |
| 5,396,277 | 3/1995 | Gast et al. | 347/33 |

FOREIGN PATENT DOCUMENTS

| | | |
|---|---|---|
| 0437361 | 7/1991 | (EP) . |
| 0494693 | 7/1992 | (EP) . |
| 0589604 | 3/1994 | (EP) . |
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 62-99153 | 5/1987 | (JP) . |
| 3290261 | 12/1991 | (JP) . |

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

When the vicinity of discharge ports of the recording head of an ink jet recording apparatus is wiped for cleaning, ink is prevented from splashing in order to avoid any spoilage in the interior of a recording apparatus due to ink stains resulting from ink splashing. The apparatus is provided with a wiping blade which is shifted to abut upon or retract from a discharge port surface of the recording head. The recording head is moved so that a relative speed is generated between the wiping blade and the recording head when the wiping blade abuts upon the recording head to clean the discharge port surface thereof. The wiping blade is retracted from the recording head in a direction parting from the recording head while there is a relative speed between the recording head and the wiping blade; the wiping blade is retracted from the recording head while the wiping blade is allowed to rotate.

12 Claims, 8 Drawing Sheets

INK JET RECORDING APPARATUS HAVING WIPING BLADE INK SPLASH PREVENTION

This application is a continuation of application Ser. No. 08/372,958 filed Jan. 17, 1995, now abandoned.

BACKGROUND OF THE INVENTION

1. Field of the Invention

This invention relates to an ink jet recording apparatus for recording on a recording medium by discharging ink from recording means.

2. Related Background Art

A recording apparatus having a printer, a copying machine, a facsimile equipment, or other functions provided therefor, or a recording apparatus used as an output equipment for a complex machine or a work station including a computer, a wordprocessor, or the like is structured to perform recording images (including characters, symbols, and others) on a recording material (recording medium) such as a sheet, a thin plastic sheet (for use of an OHP or the like) in accordance with the respective image information. Then, depending on the methods of adopted recording means, recording apparatuses can be divided into an ink jet, a wire-dot, a thermo-sensitive, a thermal transfer, a laser beam, and some other types.

In a recording apparatus of a serial type using a method which performs its main scan in the direction intersecting the direction (subscan direction) in which a recording medium is carried, images (including characters, symbols, and others) are recorded by recording means (a recording head) mounted on a carriage which travels along the recording medium after the recording medium is set in a given recording position. After a recording is completed on one-line portion, a sheet feeding (subscan) is performed for a given amount. Subsequently, the image on the next line portion is recorded (main scanned). These operations are repeated in order to record images on a desired area of the recording medium. On the other hand, in a recording apparatus of a line type which records only by the subscan in the feeding direction of the recording medium, images are recorded on the entire area thereof in such a manner that the recording medium is set in a given recording position, and then, a sheet feeding (pitch feed) is performed for a given amount while continuously making the recording on one-line portion collectively.

Of these methods, the ink jet type (ink jet recording apparatus) is to record by discharging ink from recording means (recording head) onto a recording medium, and makes it easier to arrange the recording means compactly for recording images at a high speed in a high precision. Further, with this type, a recording is possible on an ordinary paper without any special treatment. The operation is possible at a lower running cost accordingly. Also, being of a non-impact type, this method produces lesser noises. Among other advantages, it is also easier for this method to use ink of many different colors for recording color images. Particularly, for a line type recording apparatus using a line type recording means wherein many discharge ports are arranged in the width direction of a recording sheet, it is possible to perform a recording at a higher speed.

Also, among the recording means (recording heads) of an ink jet type, particularly the one which utilizes thermal energy for discharging ink enables its recording means to be fabricated still more compactly because it is possible to easily prepare its recording head with highly densified liquid passages (discharge ports) arranged in it by forming electrothermal transducers, electrodes, walls of liquid paths, ceiling board, and the like by a film formation on a base board which processed by the application of an etching, deposition, sputtering, and other semi-conductor fabrication methods. Also, by utilizing the advantages provided by IC technologies and microprocessing techniques, an elongation and surface (two-dimensional) arrangement can be easily made for recording means of this type, hence facilitating the provision of a fully multiple means for recording as well as its highly densified assembly.

Now, in the aforesaid ink jet recording apparatus wherein ink is discharged from the discharge ports onto a recording medium for recording, ink tends to adhere to the ink discharge surface of such recording head due to ink mist generated at the time of ink discharge or ink splash or the like resulting from the impact when the discharged ink arrives at the recording medium. If ink adheres to a discharge port surface of the kind, it may clog the discharge ports or cause defective ink discharges. Therefore, in consideration of such problems, a structure has been arranged conventionally to remove the ink which has adhered to the circumference of the discharge ports by wiping it with a blade made of rubber or rubbery elastic material while allowing the recording head to move in a state that this blade is in contact with the discharge port surface of the recording head.

In other words, the recording head is mounted on the carriage which is shiftable in the direction almost intersecting t he feeding direction of the recording medium, and then, the recording head is allowed to travel together with the carriage so as to traverse the blade which is positioned in a sliding area of the carriage other than the printing area, hence cleaning the discharge port surface of the recording head by use of the blade thus arranged. In this case, the blade is usually positioned on the end portion of the carriage sliding area in order to make the apparatus smaller. Therefore, the recording head moves in the direction parting from the recording medium while being in contact with the blade.

However, according to a method of the kind to clean the recording head, vibration is inevitably generated at the leading end of the blade because of its elasticity the moment the blade parts from the recording head after the wiping operation has been carried out. As a result, there occurs a drawback that the ink which is transported (transferred) to the blade is caused by such vibration splash over the recording medium. Further, the ink splashed over the recording medium is accumulated on the control board in the recording apparatus, resulting in the possible generation of hindrance such as short circuit. Therefore, to counteract this, it is necessary to adhesively bond an ink absorbent or take some other measures in a location where the ink splash may take place.

Here, in order to eliminate the vibration of the blade, a structure is proposed in Japanese Patent Laid-Open Application No. 62-99153 to make it possible to change the configuration of the discharge port surface of a recording head smoothly (to enable it to present a U-letter shape) in the direction in which the blade shifts relatively. With this structure, the displacement amount of the blade is reduced along with its relative shifting because the discharge port surface changes its configuration smoothly in the direction in which the blade shifts relatively. In this way, it is arranged to reduce the vibration of the blade. However, for the provision of this structure, it is necessary to process the discharge port surface of a recording head which is an extremely sensitive part in terms of precision. Hence there is a possibility that because of this extra process, the arrangement precision of the discharge ports, and the distance between the discharge ports and energy generating elements are caused to vary. Consequently, it becomes difficult to maintain a high rate of yield when recording heads are fabricated. Also, being extremely difficult to eliminate the vibration of the blade completely, if a highly elastic material is used for a blade while a recording head is kept traveling at a high speed, ink splashes on the recording medium eventually.

SUMMARY OF THE INVENTION

The present invention is designed in consideration of these problems encountered in the conventional techniques described above. It is an object of the invention to provide an ink jet recording apparatus which does not create ink splash when the discharge port surface of recording means is wiped for cleaning (or the wiping is performed).

Means for achieving the above-mentioned object is that in accordance with the present invention an ink jet recording apparatus is provided with a wiping member capable of abutting upon a discharge port surface of recording means, and a relative speed is generated between the wiping member and the recording means when the wiping member abuts upon the recording means in order to clean the discharge port surface thereof, and then, the contact of the wiping member with the recording means is released in the direction parting from the recording means in a state that the wiping member is on the discharge port surface while the relative speed is being generated between the recording means and the wiping member.

Another means for achieving the above-mentioned object is that in accordance with the present invention an ink jet recording apparatus is provided with a wiping member capable of abutting upon a discharge port surface of recording means, and a relative speed is generated between the wiping member and the recording means when the wiping member abuts upon the recording means in order to clean the discharge port surface thereof, and then, the contact of the wiping member with the recording means is released in the direction different from the direction in which the cleaning operation is performed for the discharge port surface after the relative speed is eliminated in a state that the wiping member is in contact with the recording means.

In accordance with these means described above, it is possible to prevent ink from splashing when the discharge port surface of recording means is wiped for cleaning, hence enabling the provision of an ink jet recording apparatus whose interior is not spoiled by ink stains.

DETAILED DESCRIPTION OF THE PREFERRED EMBODIMENTS

Figure 1:
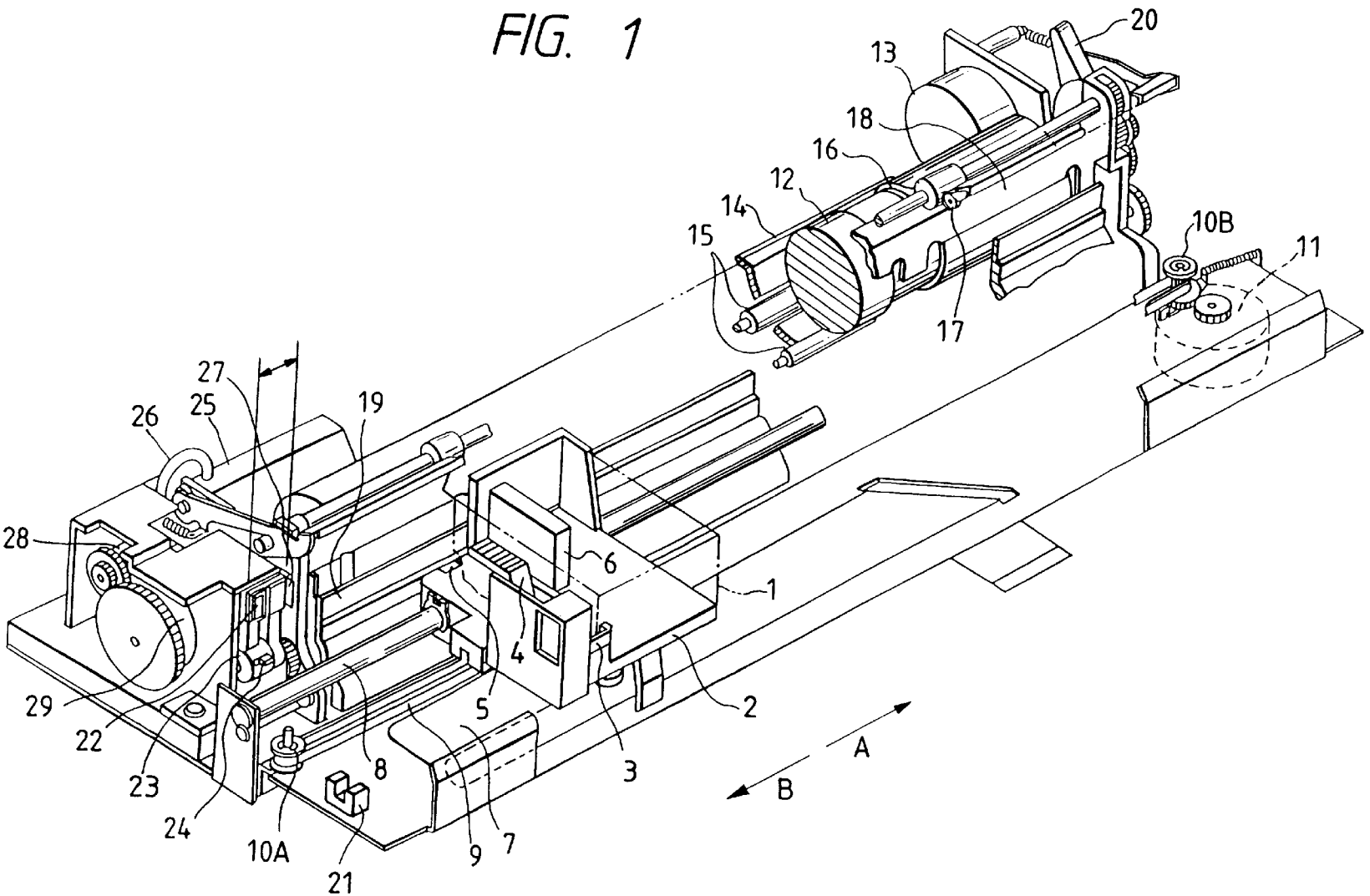
FIG. 1 is a perspective view which schematically shows one embodiment of an ink jet recording apparatus suitable for the application of the present invention.

Hereinafter, with reference to the accompanying drawings, the description will be made of the embodiments according to the present invention. In this respect, the same reference marks appearing in each of the drawings designate the same or corresponding parts. FIG. 1 is a perspective view which schematically shows one embodiment of an ink jet recording apparatus suitable for the application of the present invention. In FIG. 1, a reference numeral 1 designates recording means (a head cartridge) of an exchangeable cartridge type which is formed by a recording head and an ink tank together, and 2, a carriage having the head cartridge 1 on it, which can reciprocate in the directions indicated by arrows A and B in FIG. 1. This head cartridge 1 is electrically connected to a controller of the apparatus main body through a flexible cable 7 which will be described later.

A reference numeral 3 designates a hook for installing the head cartridge 1 to the carriage 2; 4, a lever for operating the hook 3; 5, a concaved portion formed on the carriage 2, in which is inserted the convexed portion 24 to be described later; 6, a supporting board for the electrically connecting unit with respect to the head cartridge 1; 7, a flexible cable for connecting this electrically connecting unit and the controller of the apparatus main body; 8, a guide rail inserted through the carriage 2 for supporting to guide the carriage 2 in the directions indicated by arrows A and B in FIG. 1; and 9, a timing belt coupled to the carriage 2 for transmitting the power which enables the carriage 2 to travel in the directions indicated by the arrows A and B in FIG. 1. This timing belt 9 is tensioned around pulleys 10A and 10B arranged on both sides of the apparatus, respectively. To one of the pulleys, 10B, a driving force is transmitted from a carriage motor 11 through a transmission mechanism formed by gears and others.

In FIG. 1, a reference numeral 12 designates a carrier roller, and 13, a carrier motor for driving carrier roller. The carrier roller 12 regulates the recording surface of a recording medium (recording medium) such as a sheet, and carries the recording medium (performs sheet feeding) when a recording is executed. A reference numeral 14 designates a paper pan for guiding the recording medium to the recording apparatus, and 15, a feed roller for pressing the recording medium to the carrier roller 12. The feed roller 15 is arranged on the feeding path of the recording medium, and provides a carrying force to the recording medium by pressing the recording medium to the carrier roller 12.

A reference numeral 16 designates a sheet exhaust roller for exhausting the recording medium toward an exhaust outlet which is not shown; 17, a spur arranged corresponding to the sheet exhaust roller 16. The sheet exhaust roller 16 is arranged on the downstream side of the recording position in the direction of carrying the recording medium, and the spur 17 provides the recording medium with the carrying force of the sheet exhaust roller 16 by pressing the recording sheet to the sheet exhaust roller 16. A reference numeral 18 designates a platen arranged in a position opposite to the ink discharge ports of the head cartridge 1. The platen 18 is biased to the front part of the paper pan 19 by an elastic member which is not shown.

For the ink jet recording apparatus shown in FIG. 1, an ink jet recording head is adopted as recording means (recording head) 1 to record while flying ink droplets onto a recording medium. It is therefore necessary to set the discharge ports of the recording head 1 and the recording surface of the recording medium with a small distance, and at the same time, control and maintain the distance rigidly in order to avoid any contact between the recording medium and the discharge ports. The front part of the paper pan 19 is useful for regulating the position of the recording medium in order to control the distance between the recording medium and the discharge ports appropriately.

In FIG. 1, a reference numeral 20 designates a lever for releasing the biases given to the feed roller 15, spur 17, and platen 18, respectively, when attaching or detaching the recording medium; 21, a sensor for detecting the position of the carriage 2, this sensor 21 being arranged to sense the position of the carriage 2 when the extrusion (not shown) provided for the carriage 2 passes it; 22, a cap facing the discharge port surface (the surface where the ink discharge ports are formed) of the recording head (head cartridge) 1 in the home position of the carriage 2. This cap 22 is formed by a rubbery elastic material, and supported to be able to contact with or part from the discharge port surface of the recording head 1. The cap is used to close the discharge ports airtightly when abutting upon the discharge port surface in order to protect the discharge ports of the recording head 1 out of recording operation or in a discharge recovery operation. The discharge recovery operation means a process wherein the cap 22 is allowed to abut upon the discharge port surface, and then, ink is discharged from all the discharge ports by driving the energy generating elements arranged inside the discharge ports for use of ink discharge (that is, a predischarge) or a process wherein ink is forcibly exhausted from the discharge ports by the application of suction force in a state that the discharge port surface is covered by the cap 22 so as to remove air bubbles, dust particles, overly viscous ink which is no longer suitable for recording, and others that may result in defective discharges.

In FIG. 1, a reference numeral 23 designates a pump used for the discharge recovery process. This pump 23 actuates suction force for exhausting ink forcibly, and at the same time, sucks ink received in the cap 22 when the discharge recovery process is made by the application of a forced ink exhaust described above or a discharge recovery process by the application of predischarge. On the outer side of this pump 23, a convexed portion 24 is formed, which is inserted into a concaved portion 5 of the carriage 2. Here, a reference numeral 25 designates a waste ink tank for retaining the ink waste sucked by the pump 23, and 26, a tube conductively connected the pump 23 and the waste ink tank 25.

In FIG. 1, a reference numeral 27 designates a wiping member (blade) for cleaning (wiping) the discharge port surface of the recording head 1. The wiping member 27 is made of an elastic material such as rubber, and extruded to the recording means (head cartridge) 1 side. It is movably supported in an advanced position, where it performs a wiping (wipe and cleaning) operation of the discharge port surface in the traveling process of the recording means 1, and in a retracted position, where it does not abut upon the discharge port surface of the recording means 1. Here, a reference numeral 28 designates a motor for the recovery system, and 29, a cam device for driving the pump 23, and moving the cap 22 as well as the wiping member (blade) 27 when receiving the power from the motor 28 for recovery system.

Figure 2:
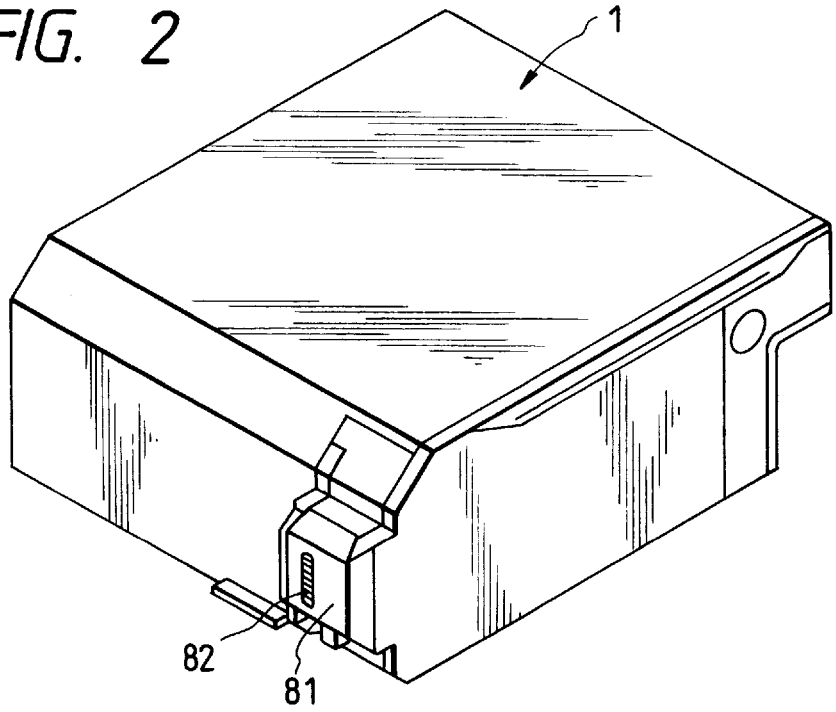
FIG. 2 is a perspective view which shows the outer appearance of recording means represented in FIG. 1.

FIG. 2 is a perspective view which schematically shows the outer appearance of the head cartridge (recording head) 1 represented in FIG. 1. In FIG. 2, the head cartridge 1 is integrally structured by the recording head unit and ink tank unit. On the front face (the front end facing a recording medium), an ink discharge unit is structured. Here, a reference numeral 82 designates discharge ports for discharging ink, and 81, the discharge port surface, where a plurality of discharge ports 82 are arranged in a specific manner.

The recording head unit of the head cartridge (recording means) 1 is an ink jet recording means which utilizes thermal energy for discharging ink, and is provided with electrothermal transducers for generating the thermal energy. Also, the recording head unit utilizes the pressure changes resulting from the development and contraction of air bubbles created by the film boiling due to the thermal energy applied to the electrothermal transducers, hence discharging ink from the discharge ports for recording.

Figure 3:
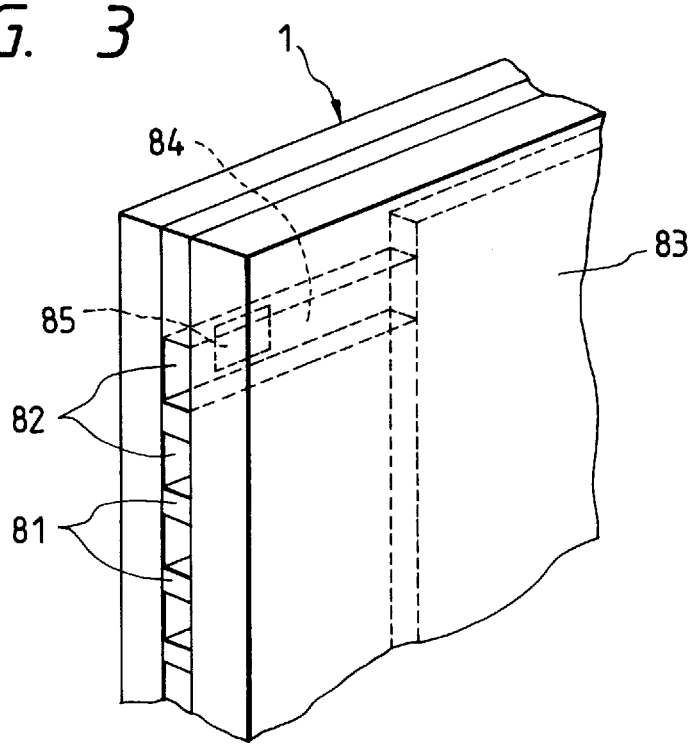
FIG. 3 is a partially perspective view which schematically shows the structure of the ink discharge unit of recording means represented in FIG. 1.
Figure 4:
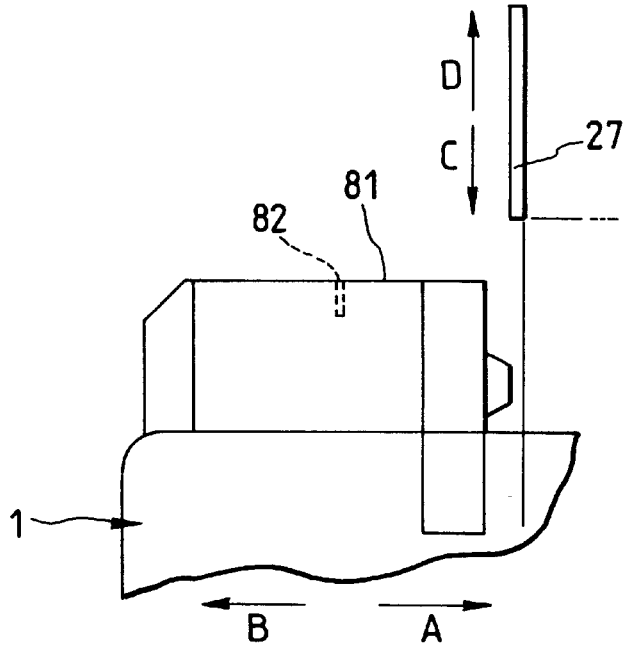
FIG. 4 is a plan view which schematically shows a state that recording means is in the standby position for cleaning in an ink jet recording apparatus to which the present invention is applicable.

FIG. 3 is a partially perspective view which schematically shows the structure of the ink discharging unit of the head cartridge (recording means) 1. In FIG. 3, on the discharge port surface 81 facing a recording material (recording sheet or the like) at a given gap (approximately 0.5 to 2.0 mm, for instance), a plurality of discharge ports 82 are formed at given pitches, and also, each electrothermal transducer (heat generating element or the like) 85 is arranged for generating the ink discharging energy along the wall face of each liquid path 84 which conductively connects each of the discharge ports 82 and a common liquid chamber 83. In the present embodiment, the head cartridge 1 is mounted on the carriage 2 in a positional relationship that the discharge ports 82 are arranged in the direction intersecting the scanning direction of the carriage 2, hence arranging the recording means 1 in such a manner that each of the corresponding electrothermal transducers 85 is driven (energized) in accordance with image signals or discharge signals to give film boiling to ink in each of the liquid paths 84, and that by the application of pressure thus generated at that time, ink is discharged from each of the discharge ports 82 accordingly.

FIG. 4 to FIG. 9 are partial plan views which schematically show the state of the recording means (head cartridge)

Figure 10:
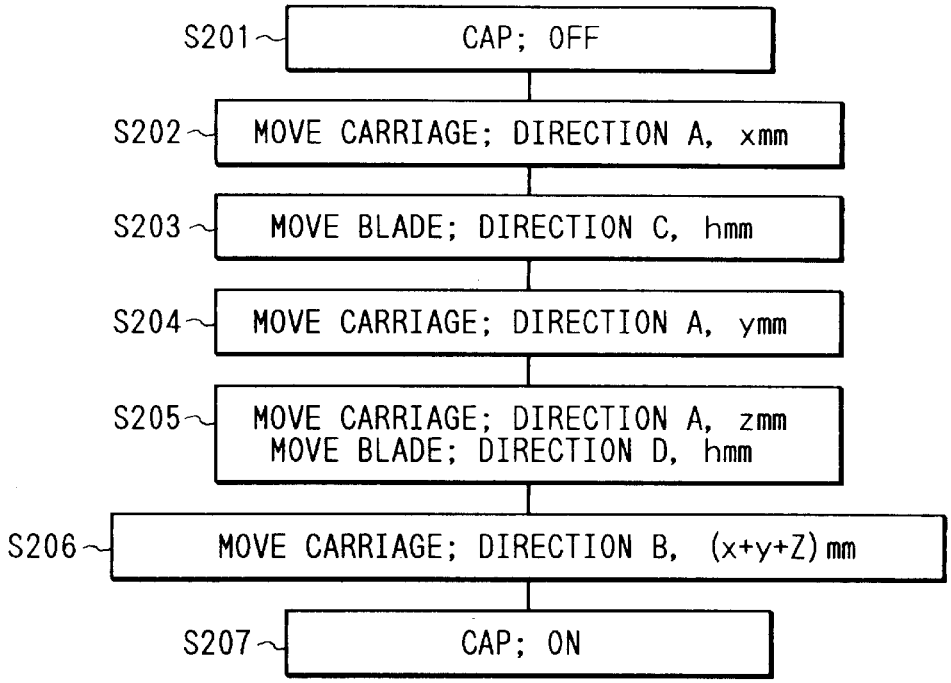
FIG. 10 is a flowchart which shows the sequence of Embodiment 1 with respect to the wiping operation of an ink jet recording apparatus to which the present invention is applicable.

1 and the blade 27 in each stage of the wiping operation, respectively. FIG. 10 is a flowchart showing the sequence of the wiping operation in accordance with the embodiment 1 for an ink jet recording apparatus to which the present invention is applicable.

(Embodiment 1)

Now, with reference to FIG. 1, FIG. 4 to FIG. 9, and FIG. 10, the description will be made of the wiping operation in accordance with the embodiment 1 of the present invention.

In FIG. 1, FIG. 4 to FIG. 9, and FIG. 10, when a wiping signal is, at first, received from a controller (not shown) in step S201, the cap 22 which is in contact with the discharge port surface 81 of the recording means (head cartridge) 1 is driven to part from the recording means 1. Then, in step S202, the recording means 1 is moved by x (mm) in the direction indicated by an arrow A by driving the carriage motor 11 to position it in the wiping standby position shown in FIG. 4. Here, the x (mm) is a relative distance between the capping state (not shown) of the recording means 1 and the state represented in FIG. 4.

Figure 5:
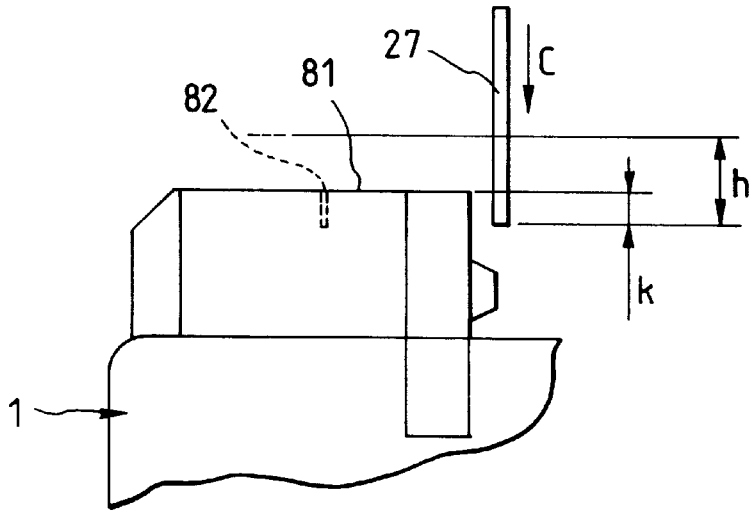
FIG. 5 is a plan view which schematically shows a state that a wiping member is advanced from its position indicated in FIG. 4.
Figure 6:
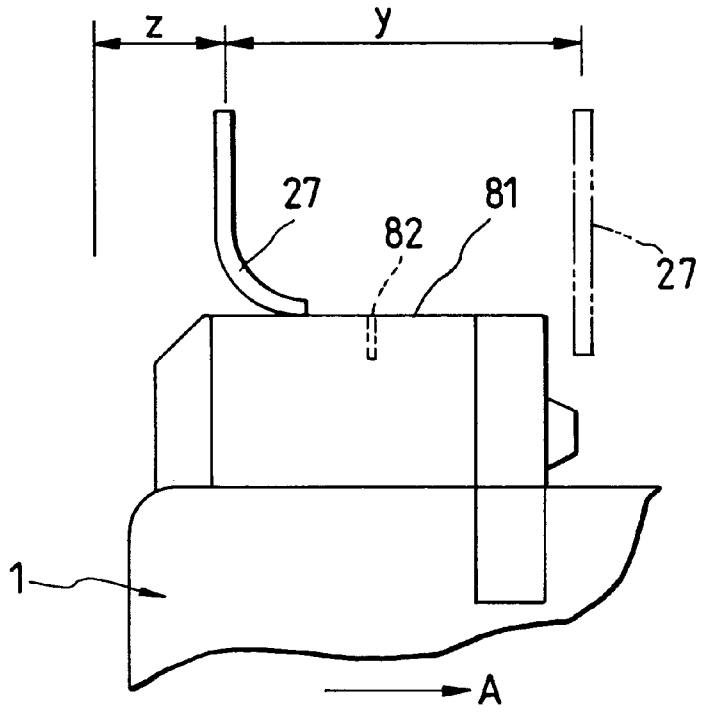
FIG. 6 is a plan view which schematically shows a state that recording means has been wiped subsequent to its state represented in FIG. 4.
Figure 7:
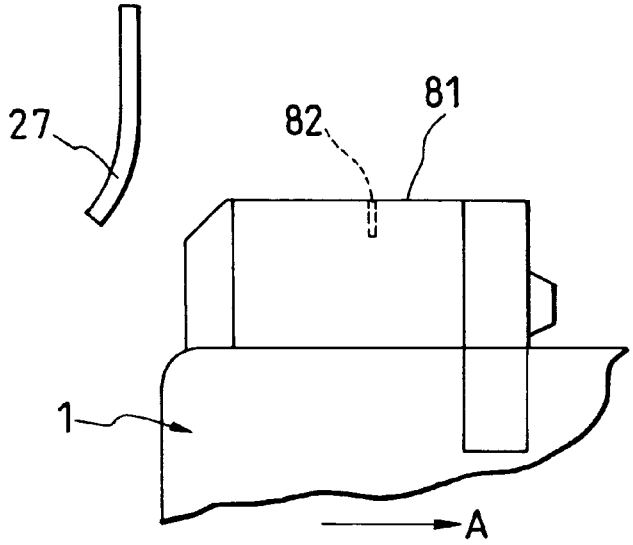
FIG. 7 is a plan view which schematically shows a state that recording means has been moved further from its state represented in FIG. 6.
Figure 8:
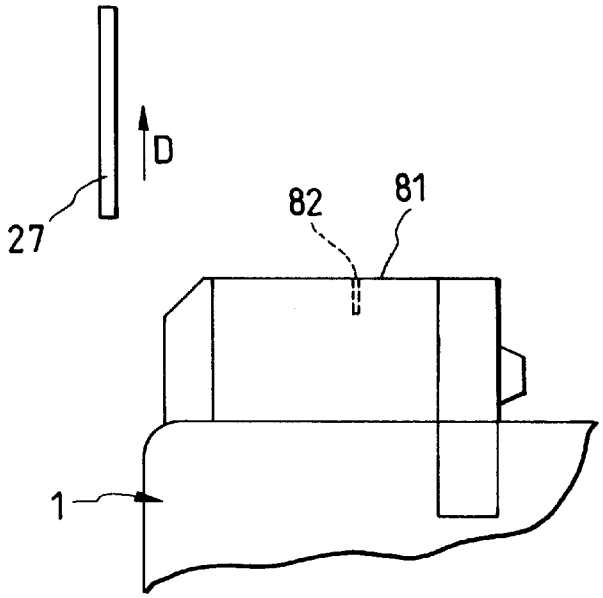
FIG. 8 is a plan view which schematically shows a state that the wiping member is retracted from its state represented in FIG. 7.
Figure 9:
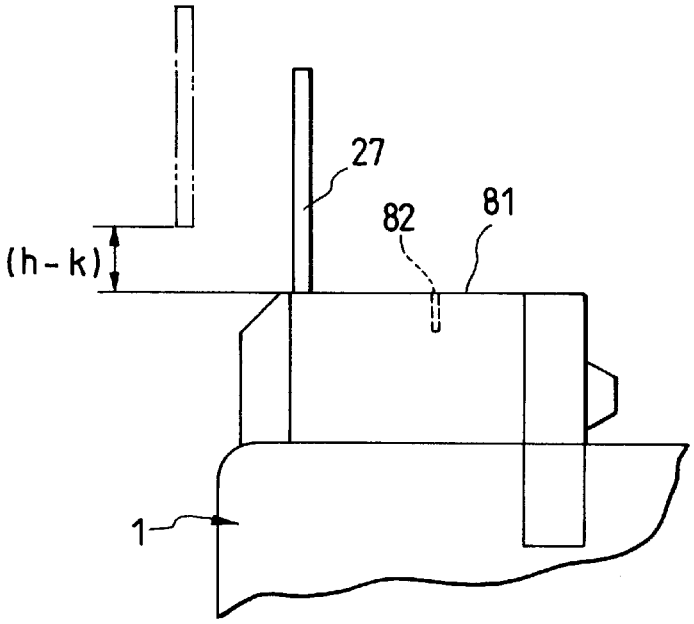
FIG. 9 is a plan view which schematically shows a state that the wiping member is positioned on the same level as the discharge port surface of recording means.

Then, in step S203, by driving the motor 28 for recovery system, the wiping member (blade) 27 is caused to shift by h (mm) in the direction indicated by an arrow C to present a state shown in FIG. 5. Here, the leading end of the wiping member 27 is extruded to superpose it over the discharge port surface 81 of the recording means 1 by k (mm). Then, in step S204, by driving the carriage motor 11, the recording means (head carriage) 1 is caused to shift in the direction indicated by the arrow A by y (mm) to present a state shown in FIG. 6. Here, in the state represented in FIG. 6, the y (mm) is set so that the leading end of the wiping member 27 can be positioned in the left side of the discharge port surface 81 in FIG. 6. Thus, by this operation, the ink which is retained on the discharge port surface 81 is removed by the wiping member 27 from the vicinity of the discharge ports 82.

Then, in step S205, the carriage motor 11 and motor 28 for recovery system are driven simultaneously in a state that the wiping member is on the discharge port surface, hence enabling the wiping member 27 to shift (part) by h (mm) in the direction indicated by an arrow D (direction intersecting the traveling direction of the carriage) while the carriage 2 is being shifted by x (mm) in the direction indicated by the arrow A. At this juncture, along with the shifting of the carriage 2, the wiping member 27 is caused to shift in the direction parting from the recording means. Thus the amount of the elastic deformation of the leading end of the wiping member 27 is made gradually smaller. In this way, the elastic deformation thereof can be eliminated almost completely when the wiping member 27 parts from the discharge port surface 81. Therefore, no vibration is generated on the leading end of the wiping member 27. Thus ink is not caused to splash, either. Also, even if the vibration of the wiping member cannot be suppressed completely because of a high speed at which the carriage moves, for example, there is no possibility that ink is allowed to splash onto to the recording medium because the amount of the elastic deformation is now small at the leading end of the wiping member, and also because the vibrating portion of the wiping member is now moved further behind.

Also, the timing, at which the execution of the step S205 begins, is good enough if only it is sometime between the wiping member having passed the discharge ports and the end of the discharge port surface. The movement of the wiping member may be performed either by electrically by the application of a signal transmitted from a sensor provided to detect the positions of the carriage or by mechanically by means of a member arranged in the traveling path of the carriage when the carriage abuts upon it.

Then, thereafter, in step S206, the carriage 2 is moved to the capping position, and in step S207, the cap 22 is allowed to be in contact with the discharge port surface 81 to close the discharge ports 82 airtightly (to execute capping), thus completing a series of capping operation.

In the embodiment described above, the direction in which the wiping member parts from recording means is the one substantially intersecting the direction in which the carriage travels. However, it may be possible to make an arrangement so that a wiping member can move to part while rotating as if drawing a circle. In this way, ink adhering to the wiping member can also be removed by the shock to be exerted by the wiping member when it rotates in parting. In this case, if an ink absorbent is provided in the position to which the wiping member is withdrawn, it is possible to remove ink more reliably. Also, in this case, if the rotational direction is arranged to be parting from the recording medium, it is possible to prevent ink from splashing more assuredly.

Also, in the embodiment described above, there is no description referring to the traveling speeds of the carriage 2 in the steps S204 and S205, but it may be possible to set them at a same level or to set the speed in the step S205 slower than the speed in the step S204. If the traveling speed of the carriage is made slower when the wiping member parts from recording means (step S205), it is possible to suppress the vibration of the wiping member, and prevent ink from splashing reliably.

Also, in the embodiment described above, there is no description referring to the speed at which the wiping member 27 parts from recording means 1, but it may be possible to adopt a method in which the speed is made slower while the leading end of the wiping member 27 is positioned on the discharge port surface 81 or a method in which the speed is gradually increased as it parts from the surface.

(Embodiment 2)

In the embodiment 1 described above, the description has been made that it is more preferable to slow down the traveling speed of the carriage when the wiping member parts from recording means, but in the embodiment 2, it is intended to remove the vibration of the wiping member as much as possible by suspending the movement of the carriage while the wiping member is in contact therewith.

Hereinafter, with reference to the accompanying drawings, the embodiment 2 will be described in detail.

Figure 11:
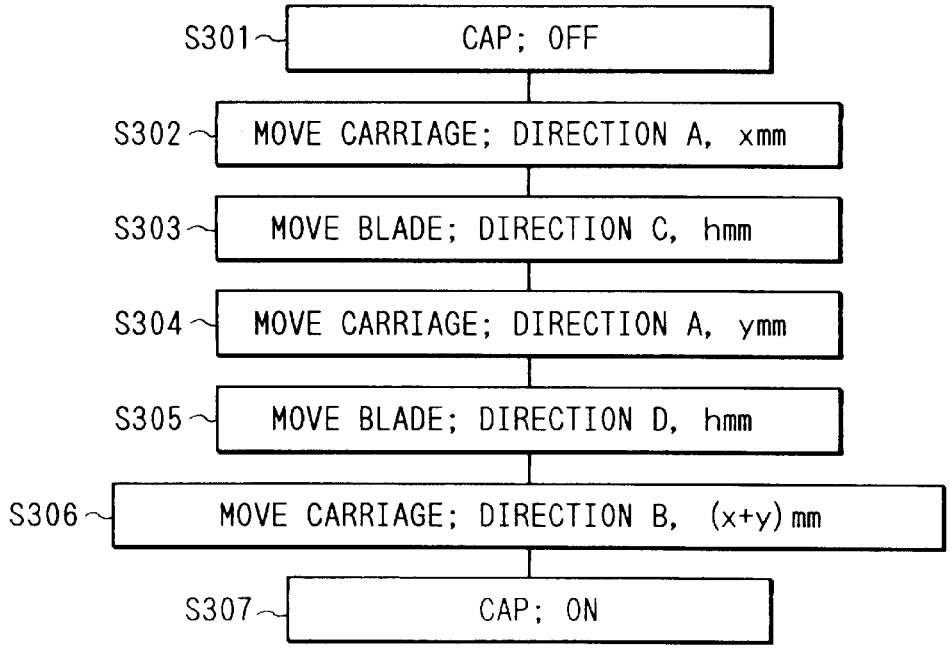
FIG. 11 is a flowchart which shows the sequence of Embodiment 2 with respect to the wiping operation of an ink jet recording apparatus to which the present invention is applicable.

FIG. 11 is a flowchart which shows the sequence of the wiping operation in accordance with the embodiment 2 for an ink jet recording apparatus to which the present invention is applicable.

Now, with reference to FIG. 1, FIG. 4 to FIG. 9, and FIG. 11, the description will be made of the wiping operation in accordance with the embodiment 2 of the present invention.

In FIG. 1, FIG. 4 to FIG. 9, and FIG. 11, when a wiping signal is, at first, received from a controller (not shown) in step S301, the cap 22 which is in contact with the discharge port surface 81 of the recording means (head cartridge) 1 is driven to part from the recording means 1. Then, in step S302, the recording means 1 is moved by x (mm) in the direction indicated by an arrow A by driving the carriage motor 11 to position it in the wiping standby position shown in FIG. 4. Here, the x (mm) is a relative distance between the capping state (not shown) of the recording means 1 and the state represented in FIG. 4.

Then, in step S303, by driving the motor 28 for recovery system, the wiping member (blade) 27 is caused to shift by h (mm) in the direction indicated by an arrow C to present a state shown in FIG. 5. Here, the leading end of the wiping member 27 is extruded to superpose it over the discharge port surface 81 of the recording means 1 by k (mm). Then, in step S304, by driving the carriage motor 11, the recording means (head carriage) 1 is caused to shift in the direction indicated by the arrow A by y (mm) to present a state shown in FIG. 6. Here, in the state represented in FIG. 6, the y (mm) is set so that the leading end of the wiping member 27 can be positioned in the left side of the discharge port surface 81 in FIG. 6. Thus, by this operation, the ink which is retained on the discharge port surface 81 is removed by the wiping member 27 from the vicinity of the discharge ports 82.

Then, in step S305, by driving the motor 28 for recovery system, the wiping member 27 is caused to shift (to be retracted) by h (mm) in the direction indicated by an arrow D, and in step S306, the carriage 2 is caused to shift to the capping position, and then, in step S307, the cap 22 is allowed to abut upon the discharge port surface 81 to close the discharge port 82 airtightly (to perform a capping), hence completing a series of a capping operation.

In the embodiment 2 described above, the relative speed between recording means (head cartridge) 1 and the wiping member 27 is eliminated while the leading end of the wiping member (blade) 27 is elastically deformed still on the discharge port surface 81. The wiping member 27 parts from the discharge port surface 81 in a state that such relative speed is zero. In this way, the elastic deformation of the leading end of the wiping member 27 is released gradually, hence no vibration being generated at the leading end of the wiping member 27 nor ink splashing being generated.

In the embodiment 2 described above, there is no description referring to the speed at which the wiping member 27 parts from recording means 1, but it may be possible to adopt a method in which the speed is made slower while the leading end of the wiping member 27 is positioned on the discharge port surface 81 or a method in which the speed is gradually increased as it parts from the surface.

(Embodiment 3)

With the embodiment 1 described above, most of the ink collected by the wiping from the discharge port surface can adhere to the blade, but in some cases, where a great amount of ink has adhered to the discharge port surface, it may be difficult to remove the ink on the discharge port surface sufficiently. In the embodiment 3, therefore, the wiping member is allowed to part from recording means only after the leading end of the wiping member has secured a state that it is in contact with the discharge port surface in order to make the remaining amount of ink on the discharge port surface as small as possible.

Hereinafter, in conjunction with the accompanying drawings, the embodiment 3 will be described in detail.

Figure 12:
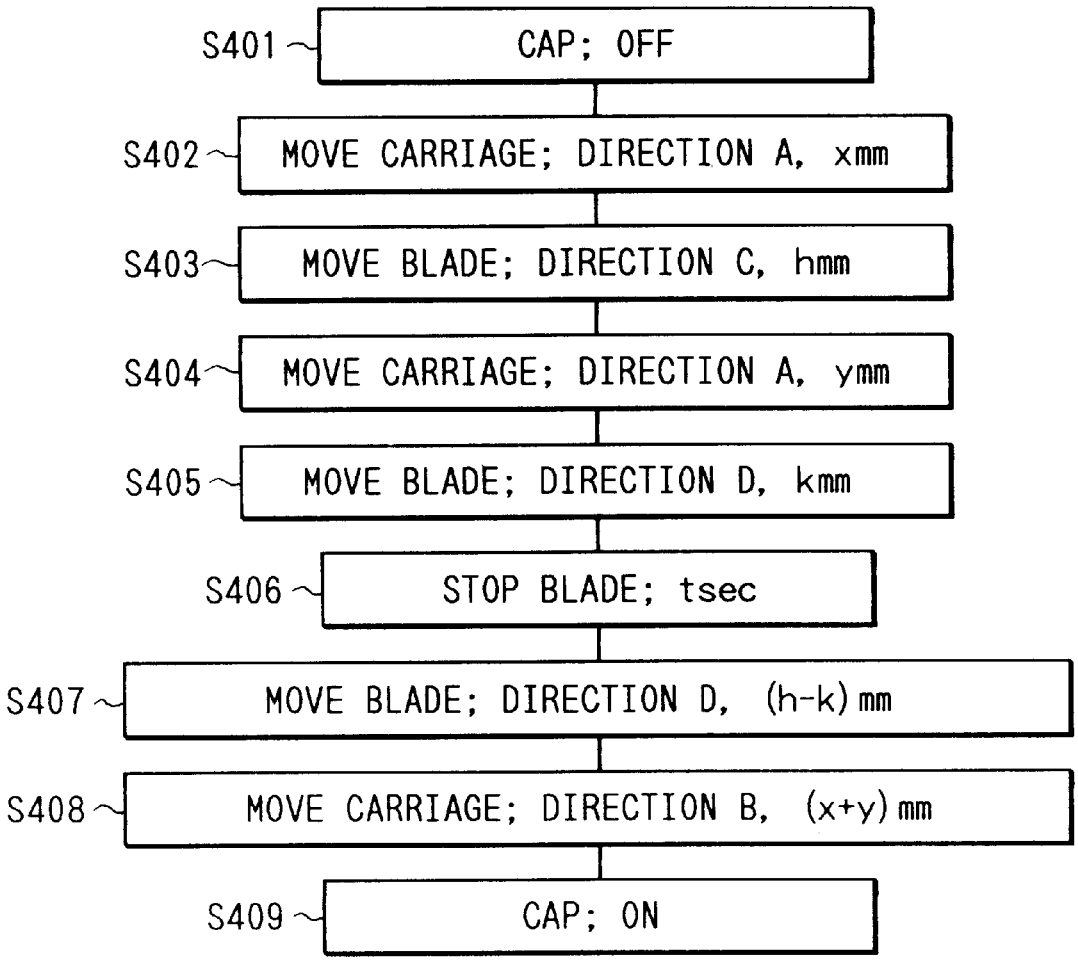
FIG. 12 is a flowchart which shows the sequence of Embodiment 3 with respect to the wiping operation of an ink jet recording apparatus to which the present invention is applicable.

FIG. 12 is a flowchart which shows the sequence of the wiping operation in accordance with the embodiment 3 for an ink jet recording apparatus to which the present invention is applicable.

Now, with reference to FIG. 1, FIG. 4 to FIG. 9, and FIG. 12, the description will be made of the wiping operation in accordance with the embodiment 3 of the present invention.

In FIG. 1, FIG. 4 to FIG. 9, and FIG. 12, when a wiping signal is, at first, received from a controller (not shown) in step S401, the cap 22 which is in contact with the discharge port surface 81 of the recording means (head cartridge) 1 is driven to part from the recording means 1. Then, in step S402, the recording means 1 is moved by x (mm) in the direction indicated by an arrow A by driving the carriage motor 11 to position it in the wiping standby position shown in FIG. 4. Here, the x (mm) is a relative distance between the capping state (not shown) of the recording means 1 and the state represented in FIG. 4.

Then, in step S403, by driving the motor 28 for recovery system, the wiping member (blade) 27 is caused to shift by h (mm) in the direction indicated by an arrow C to present a state shown in FIG. 5. Here, the leading end of the wiping member 27 is extruded to superpose it over the discharge port surface 81 of the recording means 1 by k (mm). Then, in step S404, by driving the carriage motor 11, the recording means (head carriage) 1 is caused to shift in the direction indicated by the arrow A by y (mm) to present a state shown in FIG. 6. Here, in the state represented in FIG. 6, the y (mm) is set so that the leading end of the wiping member 27 can be positioned in the left side of the discharge port surface 81 in FIG. 6. Thus, by this operation, the ink which is retained on the discharge port surface 81 is removed by the wiping member 27 from the vicinity of the discharge ports 82.

Then, in step S405, by driving the motor 28 for recovery system, the wiping member 27 is caused to shift by k (mm) in the direction indicated by an arrow D, and in step S406, the wiping member 27 is suspended to be kept in such a state for t seconds. Then, thereafter, in step S407, the wiping member 27 is caused to shift by (h−k) (mm) to the standby position (a retracted position) in the direction indicated by an arrow D, and in step S408, the carriage 2 is shifted to the capping position in the direction indicated by the arrow B. Thus, in step S409, the cap 22 is allowed to abut upon the discharge port surface 81 to close the discharge port 82 airtightly (to perform a capping) to complete a series of a capping operation.

In the embodiment 3 described above, when the wiping member 27 parts from recording means 1, the leading end of the wiping member 27 is allowed to keep the state that it is in contact with the discharge port surface 81. It is therefore possible to enable the collected ink to adhere to the leading end of the wiping member 27. As a result, the amount of remaining ink on the discharge port surface 81 can be made small. Here, in the embodiment 3 described above, there is no description referring to the shifting speed of the wiping member 27 parts from recording means 1, but it may be possible to adopt a method in which the shifting speed in the step S405 is made slower than that in the step S407 or a method in which the shifting speed in the step S405 is gradually increased.

Figure 13:
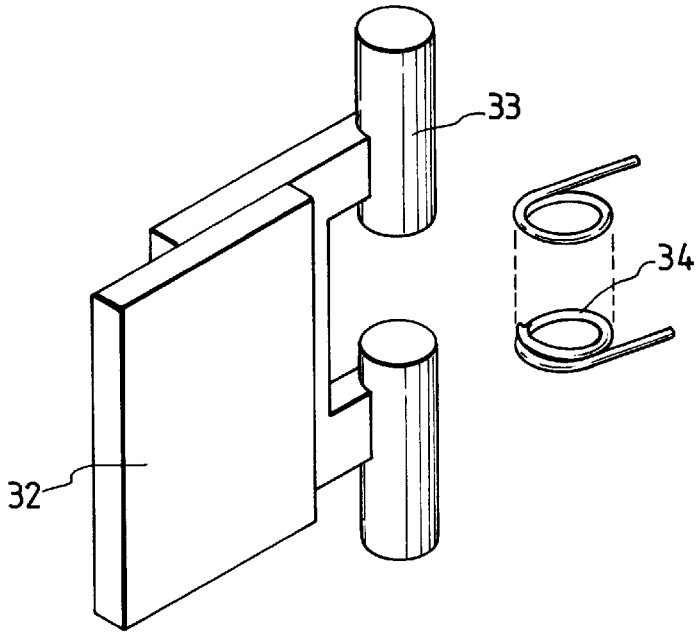
FIG. 13 is a partially perspective view which schematically shows another structural example of wiping means usable for an ink jet recording apparatus to which the present invention is applicable.

FIG. 13 is a perspective view which schematically shows another structural example of the wiping means which is usable for an ink jet recording apparatus to which the present invention is applicable. In FIG. 13, a reference numeral 32 designates a wiping member (blade) formed by a non-elastic member; 33, a holder for wiping member which holds the wiping member 32; and 34, a spring mounted on the shaft of the holder 33 for wiping member. This spring 34 enables the holder 33 for wiping member to rotate by applying a given elasticity thereto so as to press recording means 1 to be in contact with the discharge port surface 81.

For the wiping means structured as shown in FIG. 13, too, ink adhering to the leading end of the wiping member 32 tends to splash. However, it is possible to effectively prevent ink from splashing by adopting the control sequences of wiping operations each described in the embodiments 1 to 3 in conjunction with FIG. 1 to FIG. 12.

Figure 14:
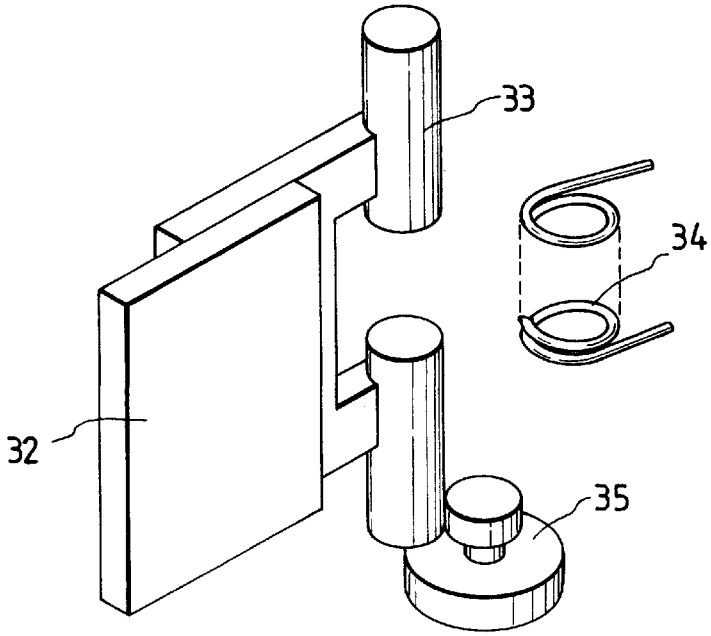
FIG. 14 is a partially perspective view which schematically shows still another structural example of wiping means usable for an ink jet recording apparatus to which the present invention is applicable.

FIG. 14 is a perspective view which schematically shows still another structural example of wiping means usable for an ink jet recording apparatus to which the present invention is applicable. In FIG. 14, a reference numeral 32 designates a wiping member (blade) formed by a non-elastic member; 33, a holder for wiping member which holds the wiping member 32; and 34, a spring mounted on the shaft of the holder 33 for wiping member to press the holder 33 for wiping member to be in contact with the discharge port surface 81 of recording means 1 by the application of a given elasticity. The structure of the wiping means shown in FIG. 14 has been the same as those represented in FIG. 13 so far.

However, in its structure shown in FIG. 14, there is further provided a damper 35 below the holder 33 for wiping member. The damper 35 is to regulate and make the rotational speed of the holder 33 for wiping member moderate. With the structure shown in FIG. 14, the speed of the leading end of the wiping member 32 becomes moderate when the wiping member 32 parts from the discharge port surface 81 of recording means at the time of terminating a wiping operation. Therefore, using a wiping member 32 of the kind, it is possible to effectively prevent the ink adhering to the wiping member 32 from splashing in a wiping operating of the discharge port surface 81 as in the cases of the first to fourth embodiments described above.

In accordance with the embodiments described above, it is possible to eliminate the ink splashing by suppressing the vibration of the leading end of the wiping member (blade) 27, 32 when recording means 1 is cleaned (wiped), and to eliminate spoilage in the interior of the apparatus due to ink stains caused by such ink splashing.

In this respect, according to the embodiments described above, while the description has been made of only the case where an exchangeable head cartridge having a recording head and an ink tank together in it is used as recording means, the present invention is applicable to any structural arrangements of the recording head and ink tank, such as a recording head and an ink tank being separately arranged or being connected by ink tube or the like. The same effects can also be obtained as those described in the embodiments.

Also, in the embodiments described above, a monochromic recording apparatus in which recording is performed by a single recording means is exemplified for description, but the present invention is equally applicable to a color recording apparatus which uses a plurality of recording means for recording in different colors or a tonal recording apparatus which uses a plurality of recording means for recording in the same color but in different densities, or further, to a recording apparatus in which these recording means are combined. The same effects can also be obtained as those described in the embodiments.

Moreover, the present invention is applicable to recording means (recording head) for an ink jet recording apparatus, which uses piezoelectric elements and other electromechanical transducers, for example. Particularly, however, the present invention brings about an excellent effect in an ink jet recording apparatus which uses recording means of a type which utilizes thermal energy for discharging ink, because with a method of the kind it is possible to attain a recording in a high density and high precision.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of recording means (recording head), thus effectively leading to the resultant formation of a bubble in the recording liquid (ink) one to one for each of the driving signals.

By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Laid-Open Application No. 59-123670 wherein a common slit is used as the discharging ports for plural electrothermal transducers, and to the structure disclosed in Japanese Patent Laid-Open Application Nos. 59-138461 wherein an aperture for absorbing pressure wave of the thermal energy is formed corresponding to the discharge ports. In other words, in accordance with the present invention, it becomes possible to perform recording reliably and efficiently irrespective of the modes of recording head.

Furthermore, as far as the applicable apparatus is of a serial type, the present invention is effectively adoptable irrespective of whether the recording head is fixed to the apparatus main body, the recording head is of an exchangeable chip type which can be electrically connected with the apparatus main body or to which ink can be supplied from the apparatus main body when it is installed in the apparatus main body, or the recording head of a cartridge type in which an ink tank is formed integrally with the recording head itself.

Also, for the present invention, it is preferable to additionally provide a recording head with recovery means and preliminarily auxiliary means as constituents of the recording apparatus because these additional means will contribute to enabling the effectiveness of the present invention to be more stabilized. To name them specifically, these are capping means for the recording head, cleaning means, suction recovery means as described above, and in addition, recovery means by use of compression, preheating means such as electrothermal transducers or heating elements other than such transducers or the combination of those types of elements. The adoption of a predischarge mode, which performs discharging other than the regular discharge, is also contributable to executing a stabilized recording.

Also, for the kinds and numbers of mounted recording heads, it is possible, as described earlier, to provide a plurality of heads for plural kinds of ink having different colors or densities, besides a single head for one monochromatic ink, for example. In other words, the present invention is extremely effective in applying it not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

Moreover, in the embodiments of the present invention described above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given. In addition, while positively preventing the temperature from rising due to the thermal energy by the use of such energy as an energy to be consumed for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium.

In such a case, it may be possible to retain the ink in the form of liquid or solid in the recesses or through holes of a porous sheet such as disclosed in Japanese Patent Laid-Open application No. 54-56847 or No. 60-71260 in order to enable the ink to face the electrothermal transducers. In the present invention, the most effective method for the various kinds of ink mentioned above is the one capable of implementing the film boiling method as described above.

Further, as the mode of the recording apparatus in accordance with the present invention, it may be possible to adopt a copying apparatus combined with a reader in addition to the image output terminal which is integrally or independently provided for a word processor, computer, or other information processing apparatus, and furthermore, it may be possible to adopt a mode of a facsimile apparatus having transmission and reception functions.

What is claimed is:

1. An ink jet recording apparatus for recording by discharging ink to a recording medium from recording means mounted for movement by moving means, said apparatus comprising:

a wiping member capable of abutting upon a discharge port surface of said recording means; and shifting means for shifting said wiping member to abut upon said discharge port surface and to retract from said discharge port surface, wherein a relative speed is generated by the moving means between said wiping member and said recording means when said wiping member abuts upon said recording means to clean the discharge port surface thereof, and then, said wiping member is retracted from said recording means in a direction parting from said recording means in a state that said wiping member is on the discharge port surface while said relative speed is being generated between said recording means and said wiping member, said wiping member is retracted from said recording means by movement of said shifting means while the wiping member rotates, and said wiping member is rotated while spaced apart from said recording means.

2. An ink jet recording apparatus according to claim 1, wherein the direction in which said wiping member parts from said recording means is the direction substantially intersecting the direction in which the cleaning operation is performed for the discharge port surface.

3. An ink jet recording apparatus according to claim 1, wherein the rotational direction of said wiping member is the direction in which said wiping member parts from a recording medium.

4. An ink jet recording apparatus according to claim 1, wherein said wiping member is retracted from said recording means in a direction different from a direction in which the cleaning operation is performed for the discharge port surface after the relative speed is eliminated in a state that said wiping member is in contact with said recording means.

5. An ink jet recording apparatus according to claim 4, wherein a speed with which said wiping member is shifted by said shifting means is made variable.

6. An ink jet recording apparatus according to claim 4, wherein the leading end of the wiping member maintains a state of being in contact with recording means for a while when said wiping member parts from the discharge port surface of said recording means.

7. An ink jet recording apparatus according to claim 5, wherein the leading end of the wiping member maintains a state of being in contact with recording means for a while when said wiping member parts from the discharge port surface of said recording means.

8. An ink jet recording apparatus according to claim 1, wherein said wiping member is made of a rubbery elastic member.

9. An ink jet recording apparatus according to claim 1, wherein said wiping member comprises a blade made of a non-elastic material, and a pressing member for pressing said blade to the discharge port surface of recording means.

10. An ink jet recording apparatus according to claim 1, wherein said recording means is an ink jet recording means provided with electrothermal transducers to generate thermal energy utilized for discharging ink.

11. An ink jet recording apparatus according to claim 10, said recording means utilizes film boiling created in ink by the thermal energy which is generated by said electrothermal transducers for discharging ink from the discharge ports.

12. An ink jet recording apparatus for recording by discharging ink to a recording medium from recording means mounted for movement by moving means, said apparatus comprising:

a wiping member capable of abutting upon a discharge port surface of said recording means;

shifting means for shifting said wiping member to abut upon said discharge port surface and to retract from said discharge port surface; and a damper member in contact with a holder which holds said wiping member, so that said damper member moderates a rotational speed of said wiping member, wherein a relative speed is generated by the moving means between said wiping member and said recording means when said wiping member abuts upon said recording means to clean the discharge port surface thereof, and then, said wiping member is retracted from said recording means in a direction parting from said recording means in a state that said wiping member is on the discharge port surface while said relative speed is being generated between said recording means and said wiping member, and said wiping member is retracted from said recording means while the wiping member is allowed to rotate.

* * * * *